United States Patent [19]

Woodard

[11] 4,268,097

[45] May 19, 1981

[54] CABINET MOLDING PROTECTOR

[76] Inventor: James Woodard, 5470 Glore Dr., Mableton, Ga. 30059

[21] Appl. No.: 2,402

[22] Filed: Feb. 14, 1979

[51] Int. Cl.[3] ..... B65D 85/48; E04B 7/00

[52] U.S. Cl. ..... 312/137; 52/94; 52/254; 206/523; 248/345.1

[58] Field of Search ..... 312/137; 248/345.1; 52/254, 94; 206/523

[56] References Cited

U.S. PATENT DOCUMENTS

| | | | |
|---|---|---|---|
| 1,935,718 | 11/1933 | Johnson | 248/345.1 |
| 2,166,798 | 7/1939 | Cote | 248/345.1 |
| 2,207,178 | 7/1940 | Richards | 52/254 |
| 2,685,147 | 8/1954 | Burr | 248/345.1 |
| 3,093,924 | 6/1963 | Pompa | 248/345.1 |
| 3,358,725 | 12/1967 | Bussard et al. | 248/345.1 |
| 3,391,509 | 7/1968 | Fruman | 52/255 |
| 3,415,019 | 12/1968 | Andersen | 52/94 |
| 3,507,079 | 4/1970 | George | 52/94 |
| 3,559,356 | 2/1971 | Koral | 52/254 |
| 3,712,003 | 1/1973 | Hallock et al. | 52/254 |
| 3,725,188 | 4/1973 | Kalt | 206/523 |
| 4,012,878 | 3/1977 | Ellingson | 52/254 |
| 4,072,231 | 2/1978 | Helms | 248/345.1 |
| 4,104,839 | 8/1978 | Balber et al. | 52/254 |
| 4,161,853 | 7/1979 | Weiss et al. | 52/254 |

FOREIGN PATENT DOCUMENTS

| | | | |
|---|---|---|---|
| 909976 | 11/1962 | United Kingdom | 248/345.1 |

*Primary Examiner*—Victor N. Sakran

*Attorney, Agent, or Firm*—Jones, Thomas & Askew

[57] ABSTRACT

A guard device protects vertical molding strips on vertical sidewalls of cabinets in grocery supermarkets and the like. Vertical molding strips on cabinet sidewalls are damaged by moving carts loaded with groceries, etc., engaging the molding strips and pulling the molding strips away from the cabinets. The guard device (10) includes an arcuate rail (18) which is supported so that it protrudes from the cabinet sidewall (13) to form a guide surface about the vertical molding strips (14) which directs grocery carts (15) or like wheeled objects away from contact with the molding.

5 Claims, 10 Drawing Figures

Fig. 1
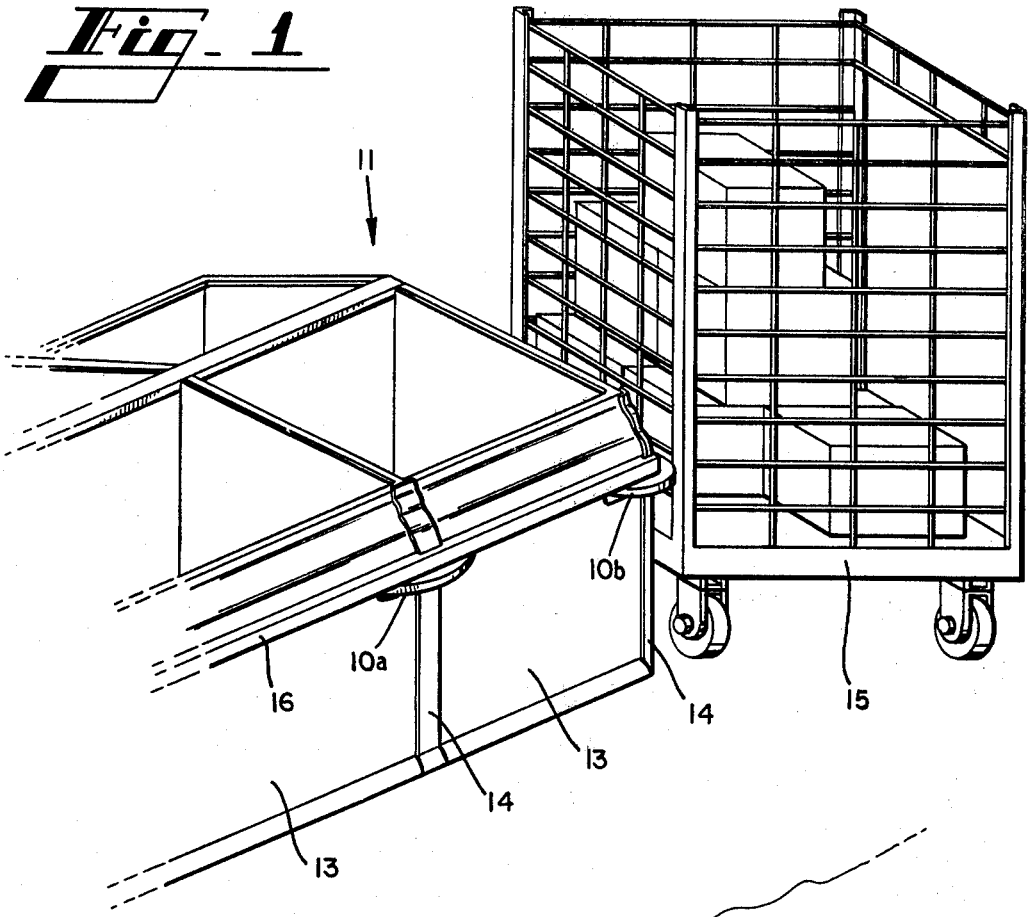
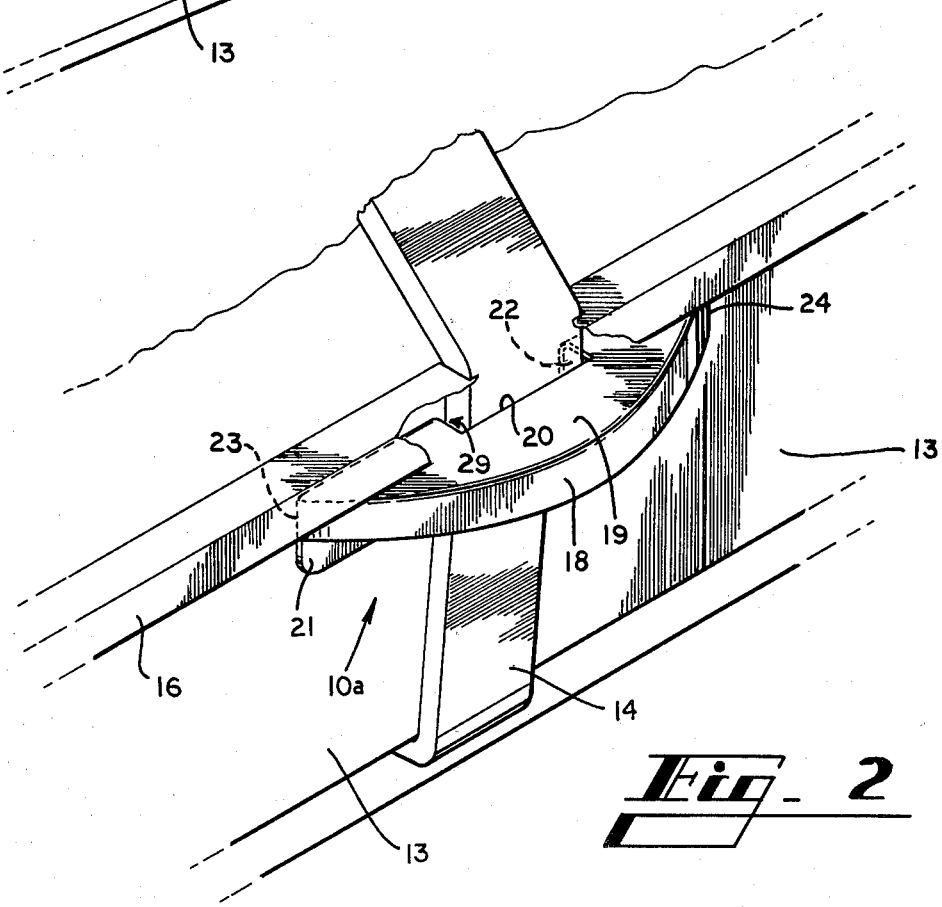
Fig. 2

CABINET MOLDING PROTECTOR

BACKGROUND OF THE INVENTION

This invention relates generally to wall and cabinet molding guard devices and, more specifically, to guard devices wherein a rigid guide rail is supported from a vertical wall of a cabinet in spaced relation to vertically exending molding or "trim" to deflect large objects approaching the molding and to direct the objects away from the wall or cabinet and its molding.

The trim or molding of cabinets or walls is used for decorative purposes, usually to cover seams where two sections of the cabinet or the wall come together. It is the nature of these trim pieces, that they protrude slightly beyond the plane of the wall and, because they extend beyond the wall surface, they are subject to being engaged by objects passing by.

One example of the problem caused by protruding moldings is readily seen in grocery supermarkets. Supermarket cabinets, especially refrigerator cabinets, are formed of a series of panels pieced together to form open top cabinets of varying sizes. Where the panels join together, be they parallel panels or panels meeting to form a corner, strips of metal or plastic trim or molding are placed over the vertical seams and serve the various functions of decorative, hiding the seam, and attaching the two panels together. These vertical trim pieces continually undergo bumps and abrasions inflicted by shoppers moving through the aisles with their shopping carts. Usually, the greatest damage to the cabinet trim is inflicted by the relatively large and extremely heavy freight carts or pallets which the stock boys wheel through the aisles daily to replenish goods on the shelves. These pallets are often as long as the aisle is wide and weigh as much as 2,000 pounds when loaded with heavier items such as canned goods and sugar. Some of the freight carts include merely a wheeled base pallet on which the goods are stacked, while others of the carts include metal cages built up from the base pallet with upright posts at its corners to prevent the goods from falling off the cart. When the corners and edges of the heavy freight carts or the products carried on the carts make contact with the vertical molding or trim of a cabinet, the carts can very easily and quite frequently do tear, bend or otherwise mutilate the trim, thus causing both unsightly and hazardous obstacles jutting out into the supermarket aisles.

SUMMARY OF THE INVENTION

Briefly described, the present invention comprises a cabinet molding protector which is attached to a cabinet wall and which spans the vertical seam and vertical molding covering the seam between two wall panels and which intercepts carts directed at the molding and diverts the carts away from damaging contact with the molding. Unlike prior art corner shields, the cabinet molding protector or guard device of the present invention is not resilient but is rigid, and its main function is not to absorb impact and stop objects but rather to divert or deflect a moving cart from its original path toward the molding and to minimize the direct force of the cart against the cabinet or wall by allowing only glancing impact against the molding protector.

The guard device is generally arcuate in shape and is mounted against the cabinet walls such that the guide rail of the guard device defines a deflecting surface beginning at one side of the vertical trim, spanning the trim and ending on the other side of the trim. The guard device is short relative to the height of the cabinet wall and can be positioned at any height above the floor along the cabinet wall, and factors such as asthetic appearance, safety, and the height of carts or pallets used by the supermarket effect the proper positioning of the device. A single guard device, positioned and aligned to properly deflect the carts, is capable of adequately protecting all portions of the vertical molding about which is mounted within the same vertical plane.

It is therefore an object of the present invention to provide a guard device which will deflect objects and guide them away from contact with walls and particularly with vertical molding or trim pieces exposed along the walls.

Another object of the present invention is to provide a molding guard device which can be quickly and easily installed on existing cabinets and walls.

Yet another object of the present invention is to provide a cabinet with vertical molding and a guard device which extends about the vertical molding to protect the molding from contact with moving carts and the like.

Other objects, features and advantages of the present invention will become apparent upon reading the following specification, when taken in conjunction with the accompanying drawing.

BRIEF DESCRIPTION OF THE DRAWINGS

FIG. 1 is a pictorial view of a cabinet, such as a supermarket refrigerated cabinet, with vertical molding and a cabinet molding side protector applied to the flat surface of the cabinet about the vertical molding and a cabinet molding corner protector applied to the corner surfaces of the cabinet about the vertical molding.

FIG. 2 is a pictorial view of the cabinet molding side protector as mounted on a cabinet.

DETAILED DESCRIPTION

Figure 3:
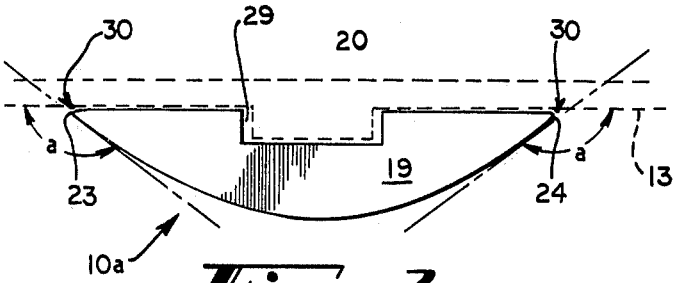
FIG. 3 is a partially broken away top view of the device in FIG. 2.
Figure 4:
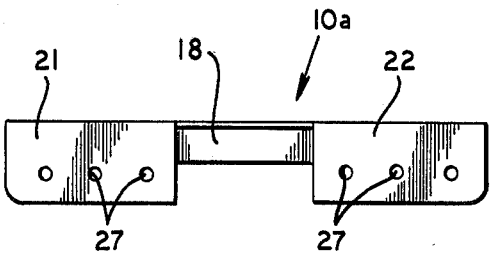
FIG. 4 is a rear view of the device in FIG. 2.

Referring now in more detail to the drawings in which like numerals represent like components throughout the several views, FIG. 1 shows the two embodiments of the cabinet molding protector of the present invention in use on a typical grocery store refrigerator cabinet 11. The two embodiments of the invention are a straight or side wall guard device 10*a* and an angled or corner guard device 10*b*. The refrigerator cabinet 11 comprises a plurality of adjacent wall panels 13 and the vertical seams (not shown) between the adjacent panels are covered by vertical trim or molding pieces 14 which overly the wall panels 13 and thus are raised slightly beyond the plane of the wall panels. The cabinet 11 further includes horizontal molding 16 which covers the horizontal edges and seens of the cabinet. The molding guard devices 10*a* and 10*b* are mounted to the wall panels 13 and span the vertical molding pieces 14. The molding protectors 10*a* and 10*b*, mounted to the cabinet 11 at the upper portions of the molding 14, deflect freight carts 15 and other potentially damaging objects away from the molding to protect the entire length of the molding.

One embodiment of the molding protector device 10*a* is shown in more detail in FIGS. 2–5. The molding protector 10*a* is a side wall protector and comprises a rigid generally arcuate shaped guide rail member 18. The guide rail member 18 is attached as by welding or otherwise to a support structure 19 which in the embodiment shown is a solid flat plate filling the area within the guide rail. Of course, any support structure, such as a skeletal framing or webbing, which will give strength to the rail member 18 to maintain the shape of the rail is within the scope of this invention. A notch 20 is defined in the support structure 19 which fits about a piece of trim or molding 14 which is to be spanned by the trim guard device 10*a*, 10*b*. Wide, flat mounting brackets 21, 22 protrude perpendicularly downward from the support structure plate 19. The two brackets 21 are located in the same plane and are positioned adjacent and extend inwardly from the ends 23, 24 of the rail member 18 and are to be parallel to and in abutment with the respective wall panels 13 to which they will be attached. The brackets 21, 22 are provided with screw holes 27 for mounting purposes. As a result of the particular shape and positioning of the mounting brackets, the forces of an impact imparted to the molding protector are distributed through the flat brackets 21 along a wide area on the cabinet wall thus giving greater effective strength to the device and lessening the chances of cracking or otherwise damaging the cabinet walls. Likewise, shearing forces inflicted by impinging carts 15 are shared by the two brackets 21, 22 thus lessening the shearing force on any one bracket and allowing for the use of ordinary wood or sheet metal screws to fasten the devices 10 to the cabinet walls.

Figure 6:
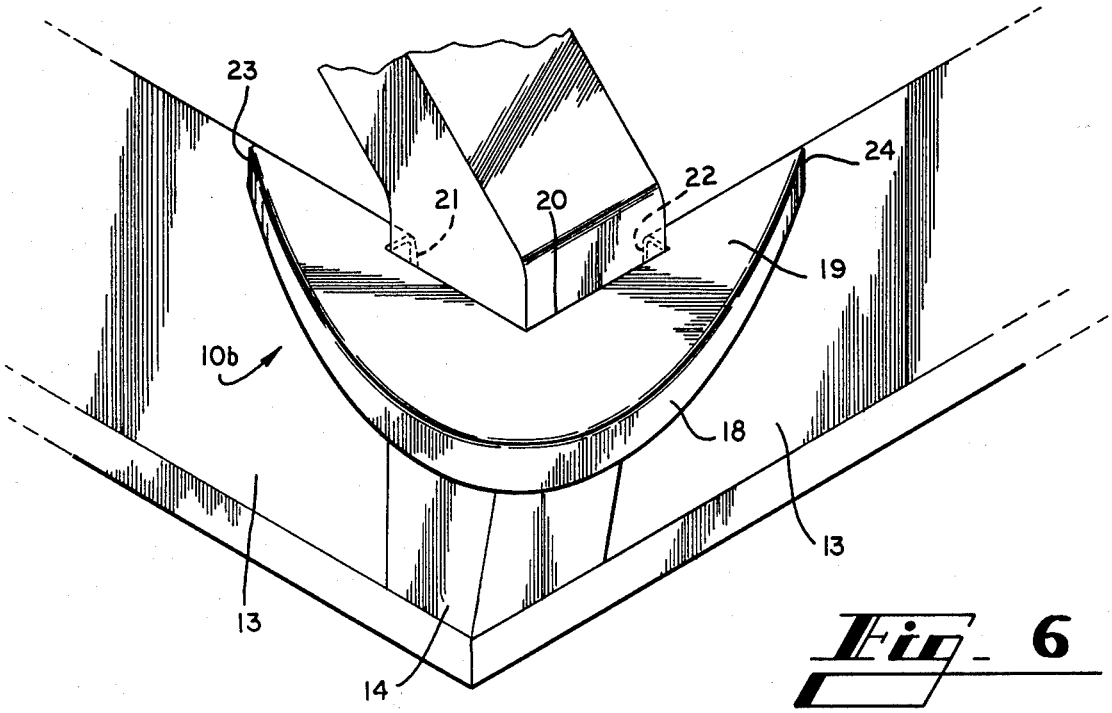
FIG. 6 is a pictorial view of the cabient molding corner protector as mounted on a cabinet.
Figure 8:
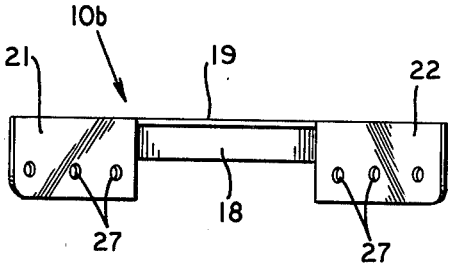
FIG. 8 is a rear view of the device in FIG. 6.
Figure 10:
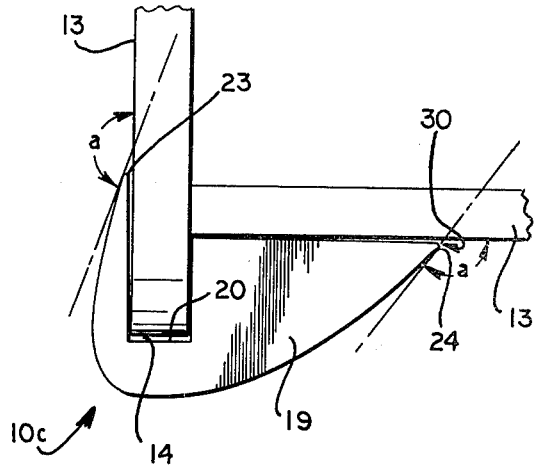
FIG. 10 is a top view of the device in FIG. 9.

The guide rail member 18 of the embodiment of FIG. 2 is for use on straight walls and the shape of the rail is a circular arc. The rail need not form a circular arc but could form a parabolic arc or other convex curve suitable to the particular arrangement of the wall panels. See for example FIGS. 6 and 9. As the guide rail 18 approaches each wall panel 13, the rail defines an obtuse angle of approach "a" with the outer face of the panel. Preferably, the angle of approach "a" is within the range of 135° to 180°. In this way, objects such as carts 15 will tend to be deflected off the rail 18 so that the rail and wall do not absorb the direct force of the cart. Although it is preferred that the guide rail member 18 be shaped in the form of a smooth continuous arc, it is understood that any comparable surface configuration which will not grab or stop a cart which contacts the rail is likewise within the scope of this invention. Even though a less uniform rail member surface can be used, the general configuration of the rail member 18 is arcuate.

Two alternative embodiments of the invention are shown in FIGS. 6–10 in the form of corner guard devices 10*b*, 10*c*. The devices 10*b*, 10*c* are shaped in accordance with the particular configuration of the corner and therefore do not generally define circular arcs as does the straight wall device 10*a*. However, the same general inventive concepts exist with respect to the corner embodiments as with the straight wall device 10*a*. A generally arcuate shaped guide rail member 18 spans the molding piece 14 and is attached to the cabinet wall panels 13 on each side of the molding 14 (and on each side of the corner) by mounting brackets 21, 22 positioned at the ends 23, 24 of the device 10. An obtuse angle of approach "a" is formed by each of the ends 23, 24 with its adjacent wall panel 13. The arc of the rail member 18 is such that direct forces of impact are minimized by deflecting objects away whenever possible rather than stopping the objects and absorbing the impact.

Figure 9:
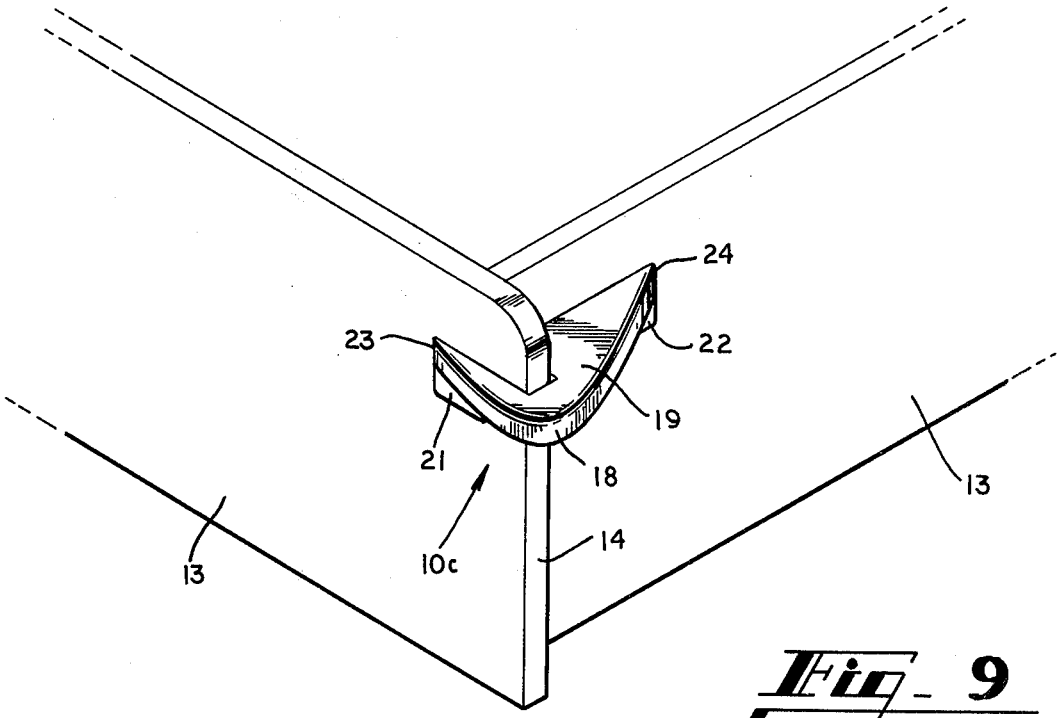
FIG. 9 is a pictorial view of another embodiment of a cabinet molding corner protector as mounted on a cabinet.

The support structure 19 of the two embodiments 10*b*, 10*c* is a solid plate which fills the space between the walls and the rails. The notch 20 cut in the plate 19 fits about the molding 14. As seen in the embodiment of FIG. 9, special variations must often be made to accommodate differently formed walls and trim.

In its preferred form, the guide rail member 18 of the present invention is made of stainless steel. Stainless steel does not easily scratch and will, therefore, not develop burrs or abrasive edges on which children can accidentally cut their hands or women can catch and ruin their clothing. The brackets 21, 22 and support plate 19 need not be stainless steel.

Figure 5:
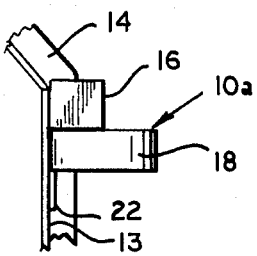
FIG. 5 is a side view of the device in FIG. 2.
Figure 7:
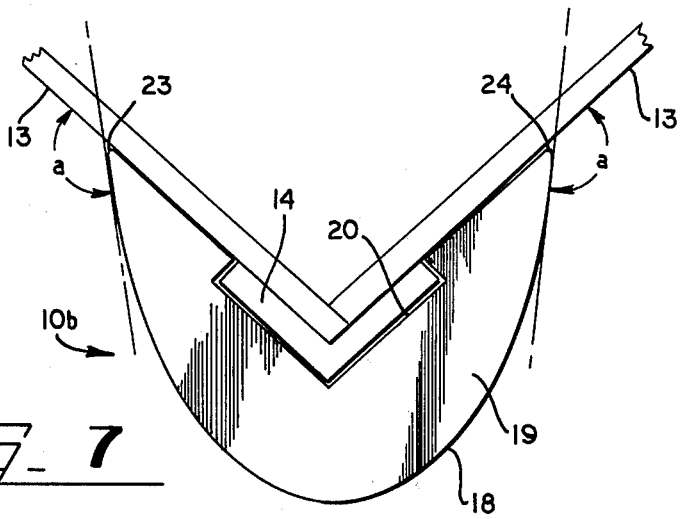
FIG. 7 is a top view of the device in FIG. 6.

Although the molding protector device can be positioned at any height above floor along the cabinet wall, in its preferred manner of use, the molding protector device is mounted to the cabinet wall immediately beneath and adjacent a strip of horizontal molding 16 as shown in FIGS. 1, 2 and 5. This arrangement has the particular advantage that the notch 20 is hidden beneath the horizontal molding 16 and in the event that the notch is wider or longer than the strip of vertical molding 14, any gaps 29 thus formed between the support structure plate 19 and the vertical molding 14 will be covered by the adjacent strip of horizontal molding 16. By so mounting the molding protector recessed immediately beneath the horizontal molding 16, manufacture of the protector is made simpler since the manufacturer need not be overly concerned with forming the notch 20 to conform exactly to each and every differently shaped and designed strip of molding. Since these gaps 29 between the plate 19 and vertical trim 14 are covered by the horizontal molding 16 and thus not exposed they do not represent potentially dangerous openings in which children can accidently cut their fingers or accidently catch and break a finger.

Furthermore, positioning of the molding protector immediately beneath a horizontal molding 16 has the further advantage that the horizontal molding 16 protrudes beyond the wall panels 13 and thus partially covers the ends 23, 24 of the molding protector. Since the molding protector 10 is a separate component attached to the cabinet panel 13 there is generally a slight space 30 (see FIG. 3) between the ends 23, 24 of the guide rail 18 and the wall panels 13, at their points of intersection. Positioning of the molding protector 10 immediately below the horizontal molding 16 obstructs access to the ends 23, 24 of the rail 18 by passing carts, and minimizes the possibility that a cart 15 will hit the ends 23, 24 of the rail 18 and that the rail and cabinet will absorb much greater force from the impact than normal. The horizontal molding 16 channels the cart 15 so that its initial contact is made with the guide rail 18 somewhere beyond the end 23, 24 along the arc. Thus, the device better serves its intended function of deflecting the cart to avoid absorbing the full force of the impact.

While this invention has been described in detail with particular reference to preferred embodiments thereof, it will be understood that variations and modifications can be effected within the spirit and scope of the invention as described hereinbefore and as defined in the appended claims.

I claim:

1. In combination with a cabinet including two adjacent wall panels defining a vertical seam between said panels and a strip of vertical molding covering the seam, and a strip of horizontal molding intersecting the strip of vertical molding, a molding protector comprising a rigid, generally arcuate shaped rail member attached to said cabinet in a horizontal attitude beneath said strip of horizontal molding and spanning said strip of vertical molding, said rail member including a first end approaching one of said adjacent wall panels beneath said strip of horizontal molding on one side of said strip of vertical molding forming an obtuse angle of approach with the outer surface of said one wall panel, and a second end approaching the other of said adjacent wall panels beneath said strip of horizontal molding on the other side of said strip of vertical molding forming an abtuse angle of approach with the outer surface of said other wall panel, and the central portion of said strip protruding out from beneath said strip of horizontal molding and spanning said strip of vertical molding.

2. A molding protector for protecting strips of molding at the intersection of horizontally and vertically extending strips of molding applied to approximately vertical flat surfaces of a refrigerator cabinet or the like, said molding protector comprising a pair of substantially flat mounting brackets positioned in spaced apart relationship with respect to each other for placement in flat abutment with the vertical surfaces of a cabinet on opposite sides of vertically extending molding and beneath horizontally extending molding, a substantially flat support plate rigidly connected to said mounting brackets at the upper edge portions of said mounting brackets and extending at a right angle with respect to said mounting brackets to project in a horizontal plane away from the vertical surfaces of the cabinet out from beneath the horizontal molding, said support plate defining a notch therein between said mounting brackets for receiving the vertical molding, said support plate terminating at its edge opposite to said mounting brackets in an arcuate guide rail, said arcuate guide rail extending at a right angle downwardly with respect to said support plate and spanning the notch in said support plate and the vertical molding received in said notch, said arcuate guide rail merging at its opposite ends with said support plates at acute angles so that the opposite ends of the arcuate guide rail are located beneath the horizontal molding.

3. The molding protector of claim 2 and wherein said pair of mounting brackets are oriented in a common plane.

4. The molding protector of claim 2 and wherein said pair of mounting brackets are oriented at right angles with respect to each other.

5. The molding protector of claim 2 and wherein said mounting brackets extend from said support plate a distance greater than the extension of said arcuate guide, and wherein said mounting brackets define holes therethrough for receiving screw connectors or the like.

* * * * *